United States Patent [19]

Jamison

[11] Patent Number: 4,915,856

[45] Date of Patent: Apr. 10, 1990

[54] SOLID LUBRICANT COMPOSITION

[75] Inventor: Warren E. Jamison, Edmonds, Wash.

[73] Assignee: Durafilm Corporation, Everett, Wash.

[21] Appl. No.: 256,142

[22] Filed: Oct. 6, 1988

Related U.S. Application Data

[63] Continuation-in-part of Ser. No. 72,097, Jul. 10, 1987, abandoned.

[51] Int. Cl.[4] ..... C10M 125/02; C10M 125/04

[52] U.S. Cl. ..... 252/26; 252/12; 252/25; 252/29; 252/30; 252/32.7 E

[58] Field of Search ..... 252/26, 25, 12

[56] References Cited

U.S. PATENT DOCUMENTS

| | | | |
|---|---|---|---|
| 2,543,741 | 2/1951 | Zweifel | 252/19 |
| 3,175,972 | 3/1965 | Mitacek | 252/35 |
| 3,325,405 | 6/1967 | Kamath et al. | 252/12 |
| 3,541,011 | 11/1970 | Davis et al. | 252/12 |
| 3,547,819 | 12/1970 | Davis et al. | 252/12 |
| 3,652,414 | 3/1972 | Bergeron | 252/19 |
| 3,729,415 | 4/1973 | Davis et al. | 252/25 |
| 3,745,148 | 7/1973 | Shin et al. | 252/49.8 X |
| 3,795,493 | 3/1974 | Mertl | 252/12 X |
| 3,803,037 | 4/1974 | Wygant | 252/32.7 E |
| 4,146,487 | 3/1979 | Rumierz | 252/12 |
| 4,204,968 | 5/1980 | Mack et al. | 252/26 |
| 4,216,032 | 8/1980 | Hyner et al. | 252/26 X |
| 4,239,632 | 12/1980 | Baile | 252/12 |
| 4,626,365 | 12/1986 | Mori | 252/25 |
| 4,663,060 | 5/1987 | Holinski | 252/12 |

FOREIGN PATENT DOCUMENTS

| | | |
|---|---|---|
| 283133 | 4/1963 | Australia . |
| 415956 | 9/1966 | Australia . |
| 428297 | 2/1968 | Australia . |
| 1292299 | 12/1969 | United Kingdom . |
| 2056487 | 3/1981 | United Kingdom . |
| 2186882 | 5/1985 | United Kingdom . |

OTHER PUBLICATIONS

Smalheer +Smith, Lubricant Additives, 1967.

"Moly Sticks Dry Flange Lubricant", Nalco Chemical Company, 6216 W. 66th Place, Chicago, Illinois 60638, Bulletin 66-2, 5 pages.

"Nalco Moly Stick", Nalco Chemical Company, 6216 W. 66th Place, Chicago 38, Illinois, Bulletin 591, 1 page.

"Nalco 'Moly' Dry Flange Lubricant" one page information sheet, Nalco Chemical Company, 6216 W. 66th Place, Chicago, 38, Illinois.

5 information sheets, National Brand Graphite Wheel Flange Lubricating Rods, National Carbon Company, 30 East 42nd Street, N.Y. 17, N.Y.

Instructions publication GEI-81902A, General Electric Flange Lubricator, two pages, General Electric, Transportation Systems Business Division, Erie, Pennsylvania 16531.

*Primary Examiner*—William R. Dixon, Jr.
*Assistant Examiner*—E. McAvoy
*Attorney, Agent, or Firm*—Christensen, O'Connor, Johnson & Kindness

[57] ABSTRACT

A solid lubricating composition useful for lubricating the flanges of railcar wheels and rails and for other similar applications. The lubricant composition comprises from about 16% to about 25% by weight of a polymeric carrier, from about 49% to about 63% of a lubricating oil, from about 10% to about 16% of a solid lubricating powder, and from about 6% to about 16% of a surface active agent, all percentages by weight of the total composition. The solid lubricant composition is mixed and introduced into a screw type extruder wherein it is heated and extruded through a die into a waterbath, forming an elastic rod or strand. The lubricant composition is applied to a surface to be lubricated by rubbing it onto the surface in a thin film. The surface active agent enhances the attachment and embedment of the dry lubricating powder into the surface being lubricated, the lubricant composition serving to reduce both wear and friction between contacting surfaces lubricated thereby.

78 Claims, 6 Drawing Sheets

LUBRICATING COMPOSITION (EXAMPLE 1)
GAGE PRESS. (psi.)
300
250
200
150
100
50
WEAR (g)
0.03
0.02
0.01
0
ROD RUBBING
DRY
WHEEL SPECIMEN
RAIL SPECIMEN
0
10
20
30
40
50
60
62
64
66
68
70
72
74
76
78
THOUSANDS OF REVOLUTIONS OF WHEEL SPECIMEN DISK

SOLID LUBRICANT COMPOSITION

This application is a continuation-in-part application based on prior copending application Ser. No. 07/072,097, filed on July 10, 1987 abandoned.

TECHNICAL FIELD

This invention generally relates to an antiwear and friction reducing compound and, more specifically, to a solid lubricant that includes a lubricating powder.

BACKGROUND INFORMATION

Hydrocarbon petroleum based lubricants are normally applied as a liquid or a viscous grease. However, in applications where the surface to be lubricated is part of a body rotating at a relatively high speed, conventional lubricants may be slung off into the environment or may creep onto an adjacent area where lubrication is neither needed nor desired. A problem such as this exists in the rail industry wherein there is a need for lubricating the flange on the periphery of railcar wheels to reduce friction and wear between the wheels and the sides of the steel rail on which the wheels run. Oil or grease applied to the wheel flanges is thrown off, polluting the area adjacent the track. In addition, a conventional lubricant quickly spreads from the flange onto the wheel tread and onto the crown of the rail, thereby reducing traction between the driving wheels of locomotives and the rail, and creating a potential safety hazard by increasing the distance needed to stop the train.

In attempting to avoid the above problems, solid lubricant sticks have been developed in the prior art, which may be used to apply a lubricating film to the flanges of railcar wheels. One of the commercially available lubricating sticks includes a catalytically cured molybdenum disulfide compound molded in a cylindrical foil wrapper. The lubricating stick is mounted in a tubular applicator and is biased against the flange of a railcar wheel by a weight.

A similar stick or rod-type lubricant comprises a graphite based lubricating composition core enclosed in a molded "electric furnace" graphite shell. The graphite stick is placed in a tubular applicator and is biased against the wheel flange with a helical coil spring.

The dry lubricant sticks of the prior art overcome some of the problems associated with lubricating railcar wheels using conventional oil or grease; however, they fail to provide a complete solution to the problem. Both types of prior art dry lubricant sticks are fragile, being made of hard, brittle materials, which tend to break easily. Each of the prior art dry lubricant sticks represents a maintenance problem because of their relatively small physical size and the rate at which they are applied. Due to their relatively short length, they must be replaced approximately every 4,000–6,000 miles—much too often to be practical for use on trains traveling several hundred thousand miles per year. In addition, it is impractical to mount a lubricant applicator on each wheel of the train, or even on each car. Ideally, one applicator should be mounted on each side of a train, e.g., on two opposite wheels of a locomotive. The applicator should apply a lubricant film to the wheel flange that is transferred to the side of the rail, and from the rail, to all the wheels of trailing cars, on that side of the train. The prior art solid lubricant sticks are unable to provide lubrication to more than a few wheels, because the dry lubricant provided in the sticks does not transfer well and does not attach or bond well to the metallic surface of railcar wheels that subsequently pass over the track.

Other solid lubricating compositions are known in the prior art that might be useful in this type of application. For example, in U.S. Pat. No. 3,729,415, a lubricating composition is disclosed comprising a hydrocarbon oil and polyethylene having an average molecular weight within the range of about 1.5 million to 5 million in proportions yielding a jelly-like gel. Related U.S. patents are U.S. Pat. Nos. 3,541,011 and 3,547,819, all of which teach that a compound of polyethylene and oil will have the physical characteristics of a liquid, a thin gel, or a rigid gel, depending upon the molecular weight and/or the amount used of the high molecular weight polyethylene.

A solid gel-type lubricant has a number of advantages over the lubricant sticks comprising graphite and molybdenum disulfide. The gel-type lubricant is not brittle and can easily be extruded or molded in almost any form. However, since oil is the lubricating medium in the solid gel, it is not retained on the track very well over an extended period of time and does not provide the long-term wear resistance or the ability to withstand extreme pressures characteristic of dry lubricants, such as graphite.

As an alternative to graphite, metallic powders are known to provide a substantial lubricating benefit when used as an additive in a petroleum based compound. For example, U.S. Pat. No. 2,543,741 teaches that a compound comprising flake copper, lead, and graphite in a petroleum based vehicle is useful for a thread sealing and lubricating composition. Also, in U.S. Pat. No. 4,204,968, a lubricant additive composition is disclosed comprising a lubricating liquid carrier containing a mixture of powdered copper and lead metal particles less than 20 microns in diameter which, it is suggested, function "as tiny ball bearings and platelets," operative to plate onto high wear areas.

Other additive materials are also known to enhance the load bearing capabilities of various lubricating base stocks. Zinc di(neo-alkyl) phosphorodithioate is such an additive and its use with cyclohexyl compounds is disclosed in U.S. Pat. No. 3,803,037. A lubricating additive is commercially available that includes synthetic sperm oil, zinc dithiophosphate, an organic molybdenum compound, lead naphthenate, and mineral oil, and it is intended to improve the wear resistance of liquid petroleum based oil to which it is added. However, the prior art has not taught the use of such additives in solid lubricants nor with dry powders, nor is it clear that a benefit would accrue from their use therewith, particularly, since the mechanism by which the additives function to improve wear resistance and to reduce friction is not clearly understood.

It will be apparent that the prior art does not include a lubricant composition that is entirely suitable and which meets all of the requirements for lubricating surfaces such as railcar wheel flanges. Accordingly, the present invention is directed to providing such a lubricant composition. Other objects and advantages of the present invention will be apparent from the description that follows hereinbelow.

SUMMARY OF THE INVENTION

In overcoming the problems related to conventional liquid and grease-type lubricants, the present invention is directed to a solid lubricant composition comprising in percent by weight from about 16% to about 70% of a polymeric carrier in which is dissolved from about 20% to about 70% of a lubricating oil. The composition further includes from about 10% to about 65% of a solid lubricating powder and from about 0.25% to about 18% of a surface active agent that is operative to improve the adhesion and embedment of the solid powder in a surface to which the compound is applied. The solid lubricating powder is selected from one or more of the group consisting of copper, lead, antimony, zinc, bismuth, tin, aluminum, magnesium, selenium, arsenic, cadmium, tellurium, graphite, and alloys thereof, in powdered form. The surface active agent comprises a metallic dithiophosphate and an organic molybdenum compound.

To apply the lubricant composition to a surface, it is rubbed over the surface, depositing a thin film. The lubricant composition may be formed in a mold or extruded, and in a preferred form is extruded in a rope-like strand that may be coiled and fed from a container for use in lubricating the wheel flanges of railcars. The rope-like strand of lubricant composition is biased against the flange of a rotating wheel and is transferred in a thin film to the wheel, and thence to a rail on which the wheel runs. As trailing railcars pass over the rail, the composition is transferred from the rail to their wheels. The pressure of the wheels against the rail tends to attach and embed the solid lubricant powder into the metallic surfaces to which it is applied, an action enhanced by the surface active agent.

In one preferred form, the solid lubricant composition comprises from about 16% to about 25% of polyethylene, from about 49% to about 63% of mineral oil, from about 10% to about 16% of the solid lubricating powder, including one or more selected from the group consisting of copper, lead, aluminum, and graphite, and from about 6% to about 16% of a surface active agent, all by weight of the total composition.

A method of preparing a solid lubricant composition as defined above is also provided, wherein a polymeric carrier, a lubricating oil, a lubricating powder and a surface active agent are mixed, formed into a desired shape, and cured.

The polymeric carrier used in the solid lubricating composition may be one or more selected from the group consisting of polyethylene, polypropylene, ethylene copolymer, a metallic ionomer, and polyurethane. The lubricating oil used in the composition is soluble in the polymeric carrier and may be one or more selected from the group consisting of mineral oil, vegetable oil, and synthetic oil.

According to the present invention, a method is also provided for lubricating a moving metallic surface with the solid lubricant composition described above which includes the step of forming the solid lubricant composition into a desired shape and biasing the formed solid lubricant composition against the moving metallic surface. The solid lubricant composition is thus deposited in a thin film on the moving metallic surface and is caused to attach and embed into the metallic surface by applying pressure.

In another preferred form, the solid lubricant composition comprises from about 16% to about 70% of a polymeric carrier, from about 5% to about 65% of a lubricating oil, from about 5% to about 65% of a tackifier, from about 10% to about 65% of a solid lubricating powder, and from about 0.25% to about 18% of a surface active agent, all components being measured by weight. The solid lubricating powder is selected from one or more of the group consisting of copper, lead, antimony, zinc, bismuth, tin, aluminum, magnesium, selenium, arsenic, cadmium, tellurium, graphite, and alloys thereof, in powdered form. The tackifier serves to increase the "stickiness" of the composition, so that it adheres longer to a surface on which it is deposited. The improved adherence increases the amount of solid lubricating powder which attaches and embeds in a metal surface to which the composition is applied. In the preferred composition, the tackifier comprises bitumen.

Since addition of a tackifier softens the solid lubricant composition and results in oil and tackifier "bleeding" from its outer surface, a further preferred embodiment is an article of the solid lubricant composition comprising first and second compositions. The first composition is formed as a core concentrically covered by a layer of the second composition. The first composition includes the tackifier and the second composition, in one embodiment, comprises an extrudable polymer and in another embodiment, comprises a solid lubricant composition not including the tackifier. In a further embodiment, components of the solid lubricant composition are divided between the first and second compositions, and these components are mixed when the article is rubbed on a surface. The article preferably comprises a coextruded, flexible strand. A method of producing an article of the solid lubricant composition having a core and concentric outer layer of distinctly different composition is another aspect of the invention.

DESCRIPTION OF THE PREFERRED EMBODIMENTS

Figure 1:
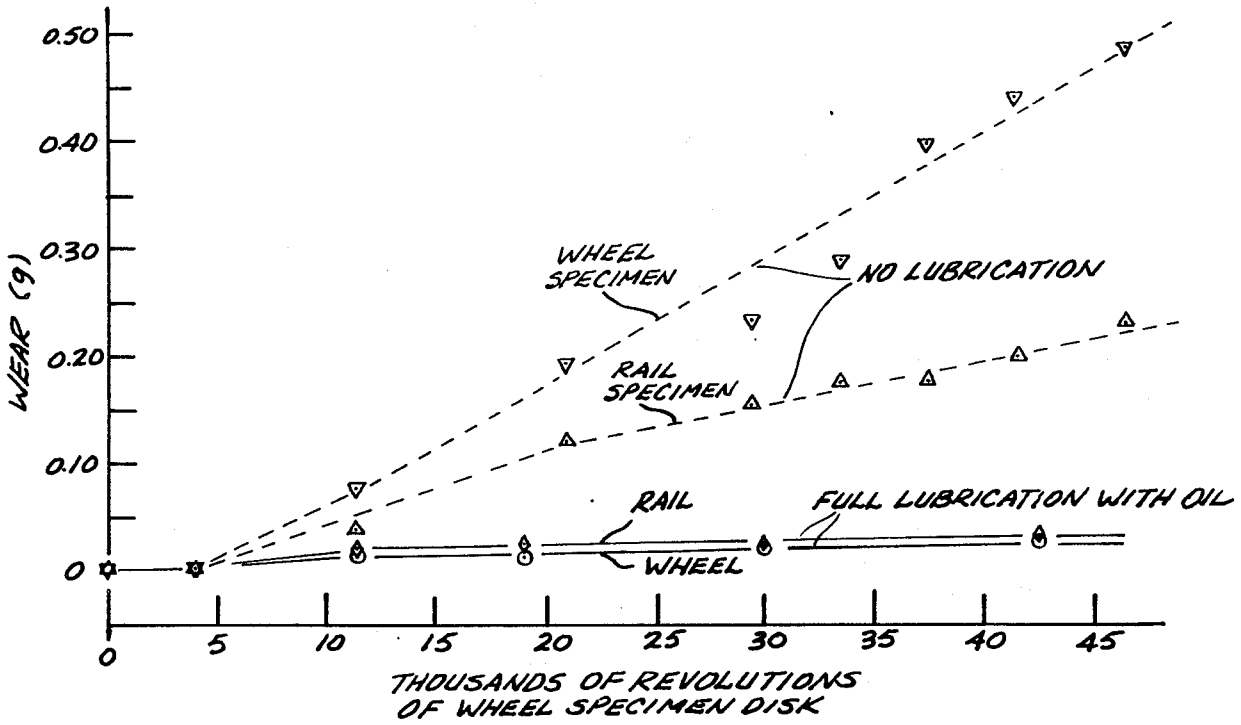
FIG. 1 is a graph showing the wear of a simulated railcar wheel and rail on which the wheel is run as determined in a laboratory test, both under dry conditions and when lubricated by an oil bath, where wear is measured as grams of weight loss as a function of thousands of revolutions of the wheel.

As noted above, the present invention was developed particularly for use in lubricanting the wheels of a railcar and the track on which those wheels run, both to reduce friction and to reduce wear of the wheels and the rail. However, it is not intended that the solid lubricant composition comprising the present invention be limited to that specific application, since it is also useful in many similar lubricating applications. In general, it has been found that relatively small amounts of the solid lubricating composition may be applied to any metallic surface, thereby greatly reducing friction and improving wear resistance when the surface is subjected to shear forces.

EXAMPLE I

A first preferred embodiment of the solid lubricating composition includes the following materials given in terms of their proportion by weight of the total composition:

fine copper powder 5%[1];
fine lead powder 5%[1];
mineral oil (motor oil - grade SAE 30) 49%;
ultrahigh molecular weight polyethylene powder 25%[2];
liquid surface active agent (additive ULC) 16%[3].

[1]Both the copper and lead powders were sized at −325 mesh and were obtained from SCM Metal Products as product codes 411002 and 511013, respectively.
[2]Obtained from American Hoechst Corporation as GUR UHMW-polymer.
[3]The liquid surface active agent (additive ULC) was at one time commercially available from United Lubricant Corp., but that company is no longer in business. The surface active agent comprises the following proportions by percent weight: synthetic sperm oil 8%; primary zinc dithiophosphate 3%; organic molybdenum compound 2.4%; lead naphthenate 4%; and mineral oil 82.6%.

The above materials were introduced into a bowl in the indicated proportions and mixed thoroughly by hand with a spoon. (Larger quantities of the materials comprising the lubricant composition made according to other Examples described hereinbelow were mixed in a commercial dough mixer.) Mixing continued for sufficient time to produce a homogeneous, viscous mass, referred to as "a slurry." The slurry was then introduced into the feed throat of a conventional single screw extruder of the type used for extruding plastics material. The oil included in the slurry helped to provide lubrication for the extruder screw and improved the output rate of the extruder.

The extruder used in this process has a one-inch diameter, 24:1 screw, and includes three zones of electrical resistance heating disposed along the length of its output barrel. Contrary to normal practice when used with plastic materials, no cooling was used on the feed throat of the extruder in processing the lubricant composition. A temperature of approximately 180° F. was measured on the surface of the feed throat; this elevated temperature was probably due to heat conducted from the output barrel. Heat was applied to the barrel of the extruder using the electrical resistance heaters to achieve the following temperatures at the indicated zones: zone 1–275° F.; zone 2–310° F.; and, zone 3–350° F. (where zone 1 is closest to the feed throat). The barrel of the extruder was terminated in a die designed for use under a water bath and sized to produce an extrudate having a circular cross-section of 3/16 inch in diameter. In various other of the following examples described hereinbelow, dies of differing cross-sections including ½ inch, ¾ inch, and 1 inch were also used. The extruder screw was turned at approximately 150 r.p.m. Since the die was submerged in a water bath, the extrudate emerging from the die was cooled so that it possessed sufficient tensile strength to enable it to be pulled from the downstream end of the water bath and cut into appropriate lengths. The extrusion rate provided by the particular screw extruder used was approximately 10 pounds per hour. A twin screw extruder and continuous feed processing would substantially improve the production rate.

Figure 2:
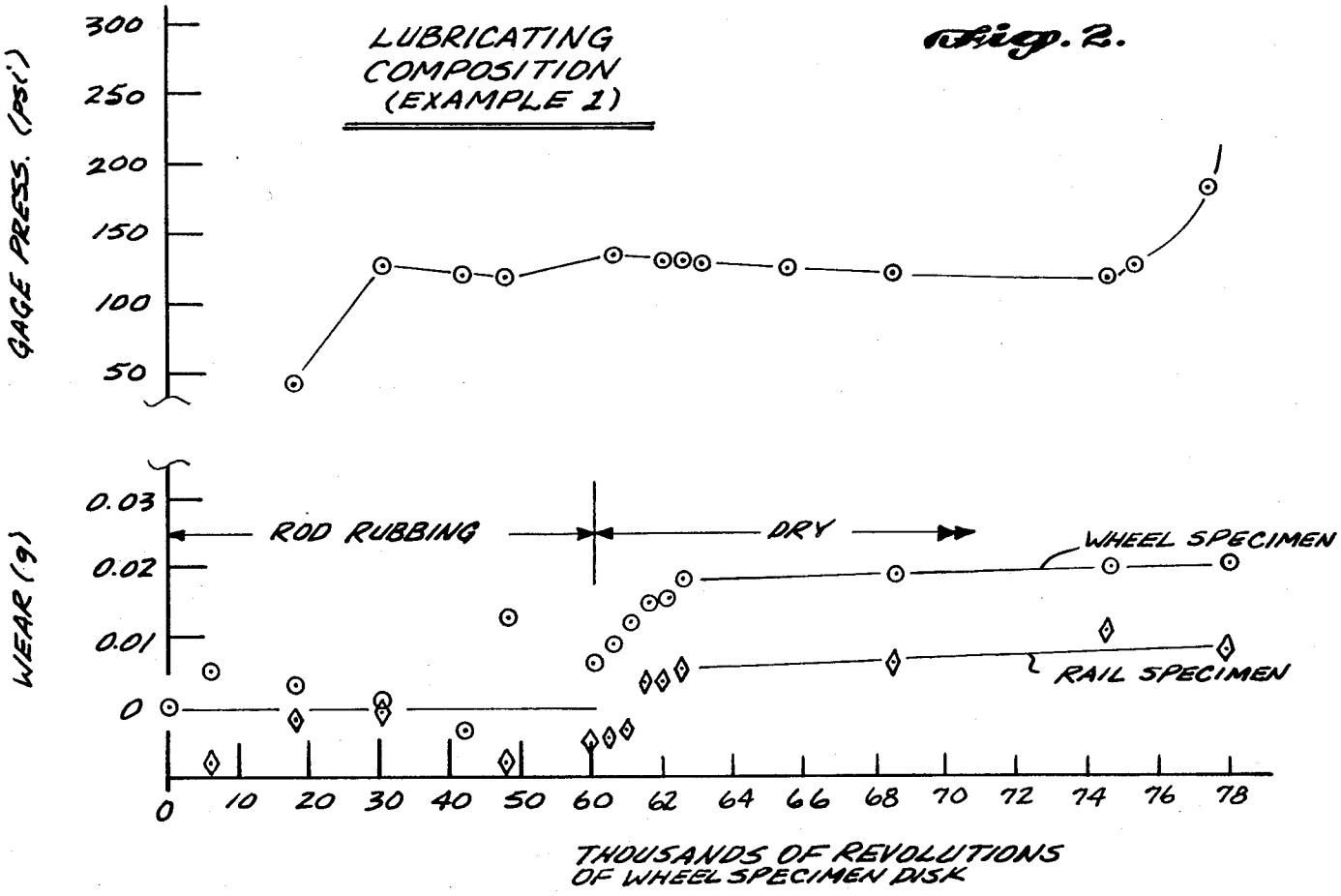
FIG. 2 is a graph showing the wear of a simulated railcar wheel and rail and the relative friction between them as determined in a laboratory test, when the wheel is lubricated with a lubricant composition made according to Example I, where wear is measured as grams of weight loss and friction is measured in terms of hydraulic fluid pressure (in psi), both determined as a function of thousands of revolutions of the wheel.
Figure 3:
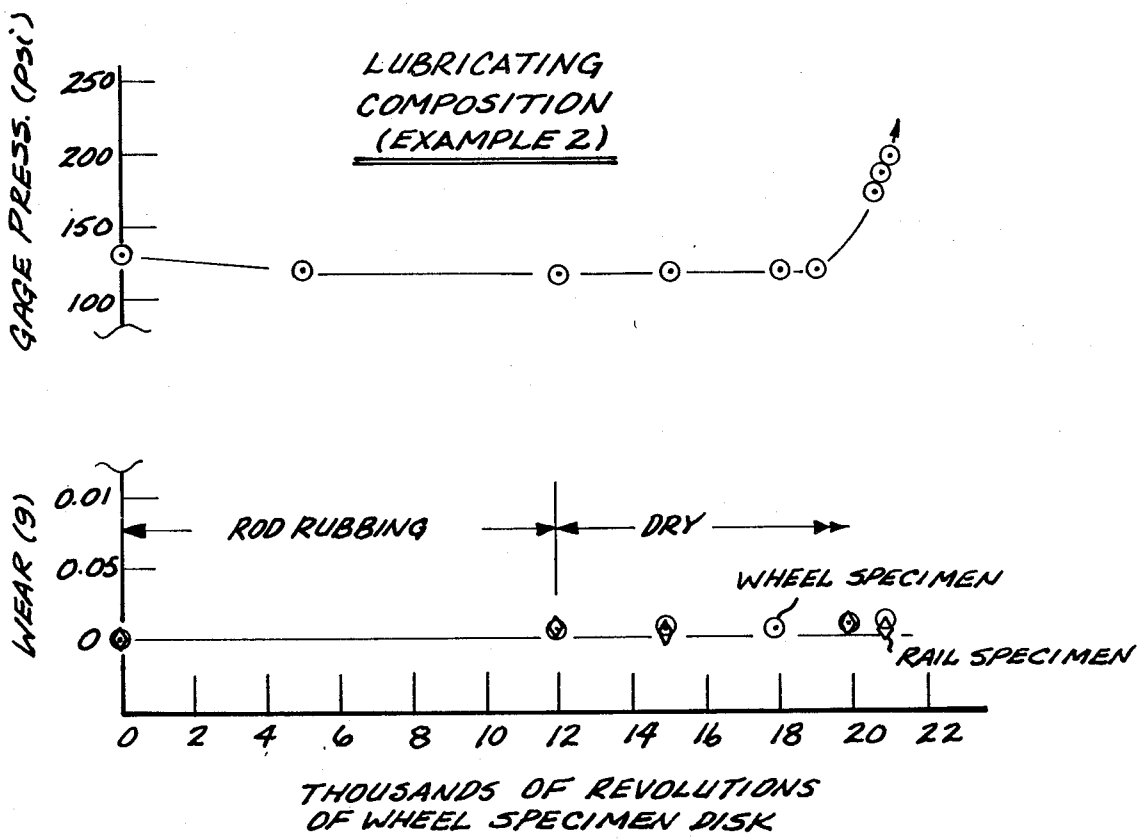
FIG. 3 is a graph showing the wear of a simulated railcar wheel and rail and the relative friction between them as determined in a laboratory test, when the wheel is lubricated with a lubricant composition made according to Example II, where wear is measured as grams of weight loss and friction is measured in terms of hydraulic fluid pressure (in psi), both determined as a function of thousands of revolutions of the wheel.

In making the laboratory tests that provided the data shown in FIGS. 1–3, a machine was used that included two disks driven by a hydraulic motor. One of the disks was made from a section of railcar wheel and the other from a section of rail. The disks were positioned on parallel axles so that their peripheral edges were biased into contact with a constant load, and were run at two different speeds, providing a 25% slippage rate between the disks, which is typical of the slippage between a wheel flange and a rail.

With reference to FIG. 1, the benefits of providing lubrication to the wheel of a railroad car are graphically shown in terms of the wear of a simulated wheel and rail on which the wheel is run, measured by weight loss (in grams) as a function of thousands of revolutions of the wheel on the rail. The two dashed lines at the top of the graph (FIG. 1) show the wear sustained by both the simulated wheel and the rail while operated dry, i.e., without any lubrication. This wear is rather significant compared to the two solid lines at the bottom of the graph, which show virtually no wear resulting from operation over the same number of revolutions when both the simulated rail and the wheel are continually lubricated with an oil bath.

FIG. 2 graphically shows the advantages of using the lubricant compostion made according to Example I for reducing the wear sustained by a simulated railcar wheel and a rail in terms of weight loss (in grams) and for reducing the friction between the two surfaces measured in terms of the pressure developed in the hydraulic system used to drive the motor by which the disks simulating the wheel and rail were rotated, both determined as a function of thousands of revolutions of the wheel specimen. On the left side of the graph, the test was conducted by positioning a rod comprising the lubricant composition of Example I, so that it lightly rubbed against the rotating wheel specimen. This was done for the first 60,000 revolutions of the disk, and generally prevented wear of both specimen disks even after the lubricant composition was no longer applied so that the only lubrication was that due to the film remaining from the initial application. The variations in weight loss for the data points shown on the graph, about the virtually flat line indicative of wear are due to the gain or loss of the lubricant composition from the wheel and rail specimen disks rather than actual changes in the mass of metal comprising the disks. The friction of the wheel specimen against the rail specimen disk was maintained at a relatively low level, even after the lubricant composition rod was no longer applied to the wheel specimen, until at approximately 76,000 revolutions, the friction started to increase dramatically, accompanied by a dramatic increase in noise level produced by the disks, indicating that the residual lubrication provided by the lubricant composition had failed. Based on this test, it appears that the lubricant composition will provide a substantial reduction in friction and wear when applied to lubricate the wheel of a railcar.

EXAMPLE II

A compound similar to that of Example I was made, except that the copper and lead powders were replaced with a powdered aluminum bronze metal alloy designated D65-MET, which is commercially available from Metco Corporation as product code 51F-NS, for use as a flame sprayed antiwear coating.

The following materials and proportions by weight were used for the lubricant composition:
aluminum bronze powder (D65-MET) 10%[1];
oil 49%;
ultrahigh molecular weight polyethylene 25%[2];
liquid surface active agent (additive ULC)[2] 16%.

[1]The D65-MET alloy comprises the following ingredients by percentage weight: iron 0.81%; aluminum 10.19%; copper 88.7%.
[2]Same as in Example I.

The compound of Example II was made according to the method used to make the compound of Example I and was extruded into a rod having similar lubricating capability. The results of a test made in the same manner as the tests performed on Example I, described above, were also made to determine the wear reduction and friction reducing characteristics of the lubricant composition made according to Example II. The results are shown in FIG. 3, wherein a rod of the lubricant composition was rubbed against a simulated railcar wheel disk during the first 12,000 revolutions of the disk, and thereafter was withdrawn so that the disk ran with only the residual lubricating film provided by the initial application. Again, minimal wear of the specimen disks was noticed during both the initial portion of the test when the rod was applied and after the rod was withdrawn; however, the residual protection provided after the lubricating composition was no longer applied lasted for only approximately 9,000 revolutions, as is evident by reference to the upper portion of FIG. 3, wherein gauge pressure is shown to rise dramatically between 20,000–22,000 revolutions of the wheel, indicating a substantial increase in friction between the wheel and the rail.

EXAMPLE II

A lubricant composition was prepared by mixing the following ingredients in the indicated proportions by weight:
copper powder 7.6%;
lead powder 7.6%;
a metal alloy powder 5.2%[1];
oil 52.4%;
ultrahigh molecular weight polyethylene 17.5%;
ethylene vinyl acetate copolymer 3.8%[2];
surface active agent 5.9%[3].

[1]Comprising copper 70%, and zinc 30% (obtained from Atlantic Metal Powders, Inc. as Richgold No. 129).
[2]Obtained from Allied Chemicals as Stock No. AC400A.
[3]Comprises inactive sulphurized fat 20%; primary zinc dithiophosphate 20%; organic molybdenum compound 20% (sulphurized oxymolybdenum organophosphorodithioate, sold as MOLYVAN ®L; this and other organic molybdenum compounds are available from R. T. Vanderbilt Company, Inc.); and lead naphthenate 40%.

The above-listed materials were mixed as a slurry and introduced into the feed throat of the extruder for extrusion according to the process described above for Example I, producing a one-inch diameter extrudate rod, which was subsequently cut into one-foot lengths. The one-foot lengths of the lubricant composition made according to Example III were installed in eight cylindrical holders on the axles of three locomotives of a train comprising 65 coal cars. The holders were positioned so that the ends of the rods were biased into contact with the wheel flanges using a mass of approximately one pound to provide the biasing force. With the lubricant composition thus being applied, the train was operated three times per day over a railroad approximately 80 miles in length, hauling coal in one direction while returning with empty cars in the opposite direction. The lengths of the lubricant composition rods were monitored as a function of time, and it was noted that the lubricant composition was being deposited onto the wheels of the cars trailing the locomotive. This was determined by inspecting the wheels of the trailing cars and by chemically analyzing a sample rubbed from the wheels of the 40th car behind the locomotives. It is thus apparent that the lubricant composition transferred from the flanges of the locomotive wheels to the rail, and subsequently was transferred from the rail to the wheels of the trailing cars.

EXAMPLE IV

A solid lubricant composition was made comprising the following materials by percentage weight:
ultrahigh molecular weight polyethylene 14.6%;
low molecular weight polyethylene 3.2%;
fine copper powder 6.3%;
fine lead powder 6.3%;
oil (motor oil of grade SAE 30) 67%;
surface active agent 1.5%[1];
lead naphthenate concentrate 1.1%.

[1]Comprising the same composition as the surface active agent used in Example III.

The above ingredients were mixed to form a low viscosity slurry, which was poured into closed cube shaped molds measuring three inches on a side. The molds were heated in an oven at 350° for three hours and allowed to cool to room temperature. The solid lubricant composition produced according to this process was a relatively hard composition which could be cut into blocks suitable for lubricating the wheel flanges of railcars.

To evaluate the performance of the solid lubricant made according to Example IV, the blocks were installed in fixtures on a special rail maintenance car used to grind the tops of rails on a high speed transit system. This transit system uses linear induction motors to propel the cars and, therefore, unlike a conventional train, there is no requirement for driving the cars by means of friction between the wheels of a locomotive and the rails. However, there was concern about the effects of reduced braking efficiency if the solid lubricant should migrate to the top or crown of the rail, or spread onto the wheel tread. To test the degradation of braking distance caused by the solid lubricant composition prepared according to Example IV, it was applied directly to the top of the rails using the special rail maintenance car as an application vehicle. Tests then conducted in which the railcars were driven over the sections of track thus treated and emergency brakes were applied. The braking distance of the train on the portion of the track which was lubricated was well within acceptable limits. Furthermore, the lubricant composition made according to Example IV was found to reduce wear and unwanted friction between the rails and the wheels.

EXAMPLE V

As an alternative to the solid lubricant composition that is formed in a rod or mold, a lubricant composition was prepared suitable for spraying onto a surface subject to wear and friction, using the following materials in the indicated proportions by weight:
urethane 68.8%[1];
liquid surface active agent 25% (additive ULC)[2];
fine copper powder 3.1%; and
fine lead powder 3.1%.
[1]Liquid, water curing polyurethane, obtained from Spencer Kellogg Corp. as Spenkel M21-40X.
[2]Comprising the same materials as used in the surface active agent of Example I.

The above materials were thoroughly mixed by hand and the resulting slurry was thinned with xylene to a relatively thin consistency suitable for spraying. The compound thus prepared was sprayed onto a simulated railcar wheel of the type used in testing the lubricant composition of Examples I and II, to a coating thickness of approximately 0.0006 inches. For purposes of comparison, a separate wheel specimen was coated with a mixture comprising only the urethane and the surface active agent omitting the copper and lead powders, and another wheel specimen was coated with only the urethane and the copper and lead powders, omitting the surface active agent. Table 1 shows the *relative* wear of the specimens, and the friction coefficient for three different operating conditions designated "mild," "severe," and "very severe," relating to the loading applied to the disks and the skew angle at which they were run, as follows: mild 12 lb. load, 0.5° skew; severe—12 lb. load, 1.1° skew; very severe—19 lb. load, 5° skew.

TABLE 1

| | Wear of Test Specimens | | |
|---|---|---|---|
| Materials | Conditions | Rail Wear | Friction Coeff. |
| No coating | Mild | 1 | 0.40 |
| Urethane + Surface Active Agent | Mild | 0.21 | 0.35 |
| Urethane + metal powders | Mild | 0.21 | 0.22 |
| Lubricant composition Example V | Mild | 0 | 0.20 |
| No coating | Severe | 1 | 0.45 |
| Urethane + Surface Active Agent | Severe | 0.51 | 0.25 |
| Urethane + metal powders | Severe | 0.36 | 0.35 |
| Lubricant composition (Example V) | Severe | 0.007 | 0.20 |
| No coating | Very Severe | 14.2 | Not determined |
| Lubricant composition (Example V) | Very Severe | 2.3 | Not determined |

Based on the results of these tests, it is apparent that the urethane and surface active agent or the urethane and metal powders are each capable of providing reduced wear and friction; however, the combination of materials comprising the lubricant composition of Example V is far more effective in reducing both wear and friction. This synergistic result is believed to occur because of the action of the surface active agent in enhancing the embedment of the metallic powders in the surfaces being lubricated. The mechanism by which this action occurs is not understood, although its effect is readily apparent. It is believed that the same synergistic benefit of using a surface active agent in combination with a solid lubricating powder occurs in the other examples described herein.

EXAMPLE VI

A lubricant composition was prepared from the following ingredients in the indicated proportions by weight:
aluminum bronze powder (D65-MET) 8%;
metal alloy powder (Richgold No. 129) 4%;
fine copper powder 3%;
oil (ISO VG 680) 63%;
ultrahigh molecular weight polyethylene 8%;
ethylene vinyl acetate copolymer 8%;
surface active agent 6%[1].
[1]Same composition as the surface active agent used in Example III.

The above materials were mixed and processed according to the method of Example I and were extruded into a one-inch diameter rod which was cut into one-foot lengths. The rods were then used to lubricate the wheel flanges of locomotives as described for Example III, with similar results.

EXAMPLE VII

A lubricant composition was prepared from the following ingredients in the indicated proportions by weight:
molybdenum disulfide 6.3%[1];
ultrahigh molecular weight polyethylene 11.8%;
ethylene vinyl acetate copolymer 7.1%;
fine copper powder 3.2%;
oil (ISO VG 680) 71%;
tackifier 0.1%[2];
surface active agent 0.5%[3].
[1]Technical grade obtained from Climax Molybdenum Co.
[2]Latex compound obtained from Heaveatex Corporation as Heveanol H-1501.
[3]Same composition as the surface active agent used in Example III.

The above materials were processed in accordance with the method of Example I, and were extruded as a one-inch diameter rod having the same elastic properties as the compositions of Examples I and III. The lubricant composition of Example VII was also found to deposit a lubricant film when rubbed onto a matallic surface.

EXAMPLE VIII

A lubricant composition was made with the following ingredients in the indicated proportions by weight:
molybdenum disulfide 1.2%;
fine copper powder 3.1%;
graphite 5%[1];
oil (ISO VG 680) 70%;
ultrahigh molecular weight polyethylene 11.8%;
ethylene vinyl acetate copolymer 7.0%;
tackifier 0.3%;
surface active agent 1.6%[2].
[1]Obtained from Superior Graphite Co. as #1 Large Flakes.
[2]Same composition as the surface active agent used in Example III.

The materials listed above were processed in accordance with the method of Example I and were used to lubricate the wheel flanges of locomotives as described in Example III, exhibiting similar friction and wear reduction properties.

EXAMPLE IX

A solid lubricant composition was made using the materials in the indicated proportions by weight:
fine copper powder 6.5%;
fine lead powder 6.5%;
oil (ISO VG 680) 67.1%;
liquid surface active agent (additive ULC) 1.5%[1];
ultrahigh molecular weight polyethylene 15.1≠%;

ethylene vinyl acetate copolymer 3.3%;
[1]Comprising the same material used for the surface active agent in Example I.

The preceding materials were processed in accordance with the method used in Example I and were extruded into a one-inch diameter rod that was cut into one-foot lengths. One of the rods was placed in a holder attached to provide lubrication to the flange of a wheel on a locomotive (by rubbing against the wheel). The locomotive was part of a train having four locomotives, pulling a special lubricator car and 85 additional cars each loaded with 100 tons of ballast. The train was run around a test track loop of approximately 2.8 miles in length, while the lubricant of Example IX was biased into contact with the wheel flange of the locomotive with a force of approximately 12 pounds. After six laps around the test loop, the rod of lubricant composition had deposited a visible film on the surfaces of the wheels of each of the succeeding cars and along the entire length of the track. The film deposited by the lubricant rod was clearly visible, and chemical analysis proved that the visible film comprised the lubricant composition of Example IX. It was also noted during the test that wheel flange noise was markedly reduced and that the normal surface roughness of the part of the rail contacted by the wheel flange was reduced.

EXAMPLE X

A lubricant composition was made with the following ingredients in the indicated proportions by weight:
fine copper powder 7.8%;
fine lead powder 7.8%;
oil (ISO VG 680) 16.6%;
jojoba oil 25.0%;
ultrahigh molecular weight polyethylene 19.0%;
low molecular weight polyethylene 7.1%;
liqiud surface active agent (additive ULC) 16.7%[1].
[1]Comprising the same materials as in the surface active agent used in Example I.

The materials listed above were mixed into a viscous slurry and placed into copper tubes one inch in diameter and approximately one foot in length. The tubes were capped and heated in a furnace at a temperature of 375° F. for two hours. Before cooling completely, the tubes were removed from the furnace, uncapped, and the lubricant composition was forced out. The rods thus formed were found to comprise a hard, elastic solid material having the same lubricating properties as the extruded rods of Examples I and III. Tests of the lubricant composition formed according to the process of Example X showed that it had the same ability to lubricate wheel flanges on a high-speed light rail transit train as the rods which were extruded.

EXAMPLE XI

The same materials in the same percentages by weight as in Example X were used to produce a lubricant composition, except that the ultrahigh molecular weight polyethylene and low molecular weight polyethylene were replaced by a high molecular weight polyethylene. Similar results were obtained in evaluating the lubricant composition thereby produced.

EXAMPLE XII

A lubricant composition similar to that produced in Example X was made by replacing the ultrahigh molecular weight polyethylene and low molecular weight polyethylene with an equivalent proportion by weight of polypropylene. The resulting lubricant composition appeared to have similar properties in reducing friction and wear as that produced in accordance with Example X.

EXAMPLE XIII

A lubricant composition was made in accordance with the method of Example X using the same ingredients and the same proportions, except that the ultrahigh molecular weight polyethylene and low molecular weight polyethylene were replaced by a metallic ionomer, specifically a zinc ion based ionomer obtained from DuPont under the product name SURLYN 9970. The lubricant composition thereby produced appeared to have similar qualities to that of the lubricant composition of Example X.

EXAMPLE XIV

A lubricant composition was made according to the method of Example X and the same materials were used in the same proportions, except that the ultrahigh molecular weight polyethylene and low molecular weight polyethylene were replaced by a low molecular weight ionomer, specifically one obtained from Allied Chemicals under the product name ACLYN 201A. The wear extending and friction reducing properties of the resulting lubricant composition were similar to those of the lubricant composition of Example X.

EXAMPLE XV

It is also contemplated that a composition can be made comprising the following ingredients by weight:
ultrahigh molecular weight polyethylene 8%;
ethylene-acrylic acid copolymer 2%[1];
fine copper powder 32.5%;
fine lead powder 32.5%;
surface active agent 5%[2];
oil 20%.
[1]Obtained from Allied Chemicals as product ACE540A.
[2]Comprising the same materials used in the surface active agent of Example III.

It is believed that a lubricant composition made using the above listed materials according to the method of Example I will have superior lubricating properties and will be useful for lubricating the wheel flanges of a railcar and in other similar lubricating applications due to the relatively higher concentration of solid powders, which should provide enhanced antiwear capability.

EXAMPLE XVI

It is also contemplated that a lubricant composition can be made from the following materials in the indicated proportions by weight:
ultrahigh molecular weight polyethylene 8%;
ethylene-acrylic acid copolymer 2%;
molybdenum disulfide 32.5%;
graphite 32.5%;
surface active agent 5%[1];
oil 20%.
[1]Comprising the same ingredients used in the surface active agent of Example III.

A lubricant composition comprising the preceding materials is believed to have superior lubrication properties for applications wherein the antiwear capability of the solid lubricating powders, i.e., graphite and molybdenum disulfide are likely to provide an advantage. The relatively higher percentage of these dry lubricating powders in the lubricant composition made according to Example XVI (following the method of Example I) should provide potentially greater antiwear characteristics than other lubricant compositions having a substantially lower percentage of dry lubricating powders.

In each of the preceding examples wherein polyethylene is used as a polymeric carrier, it is preferable to use a mixture of ultrahigh molecular weight polyethylene (having a molecular weight in excess of 750,000) in combination with a lower molecular weight polyethyelene (having a molecular weight less than 10,000) to insure the solubility of the oil and to avoid having the oil bleed from the solid lubricant composition after it has been formed into a rod. Alternatively, a high or medium molecular weight polyethylene may be used (having a molecular weight between 100,000 and 600,000) with substantially the same result. In any case, it is desirable that the oil used be soluble within the polyethylene and that the resulting lubricant composition be relatively dry, having little or no oil bleeding from the surface.

The relatively high percentage of oil present in the solid lubricant compositions made as described above enhances the extrusion process and in addition serves an important function in reducing the friction between surfaces to which it is applied. These surfaces are subject to wear during the time needed for the dry lubricating powders comprising the present solid lubricant composition to attach and become embedded in the surfaces. If insufficient lubricating oil is provided in the lubricant composition, the dry lubricant powders are carried away from the surfaces to which they should attach, by the shearing action of one surface rubbing against the other. However, once the dry lubricant powders have become embedded and attached to the surfaces, the lubricating oil ceases to have an important function in extending the antiwear and friction reducing properties of the lubricant composition. As noted previously, the surface active agents tend to enhance the attachment and embedment of the dry lubricant powders, both the metallic powders, and the nonmetallic powders, (graphite and/or molybdenum disulfide) to the surface being lubricated in a manner not previously known to occur. The pressure between the surface to which the lubricant composition is applied and another surface coming into contact therewith tends to force the lubricating powder into the metallic interstices of the surfaces, reducing the roughness of both surfaces and protecting them against wear.

In addition to the metallic powders used in the preceding examples, it is also contemplated that antimony, zinc, bismuth, tin, aluminum, magnesium, selenium, arsenic, cadmium, tellurium, and alloys thereof, such as alloys of cadmium and zinc, cadmium and tin, bismuth and zinc, bismuth and tin, and other similar soft metallic elements and alloys of such elements might be useful in the lubricant composition of the present invention. The metallic powders should range in size from −325 mesh to −200 mesh to insure the attachment of the powder to the metallic surfaces being lubricated. Where a nonmetallic material such as graphite is used, the particulate size should range from about 200 nanometers to about 0.5 millimeters.

Once it was recognized that the primary source of long-term lubrication of metallic surfaces subject to shear forces resulted from the attachment and embedment of the solid lubricating powder into the interstices of the metallic surfaces, it was theorized that the shearing motion between the surfaces might be wiping the lubricating powder from the surfaces before optimum attachment and embedment of the lubricating powder could occur. Accordingly, an attempt was made to improve the adherence of the solid lubricant composition to a surface using a tackifier additive. Tackifiers are known to increase the "stickiness" of a lubricant. Attempts to use a conventional organic tackifier in the solid lubricant composition failed, due to degradation of the organic tackifier by the heat used during the extrusion process. Howvever, a bitumen tackifier was found that could be used at the required processing temperatures without loss of its tackifying properties.

To evaluate the effect of the tackifier on the solid lubricant composition, ½ inch diameter rods of composition A and composition B were produced in accordance with the method used in Example I, from the materials listed under Example XVII, below.

EXAMPLE XVII

Compositions A and B of the solid lubricant composition were made using the materials in the indicated proportions by weight:

| | Composition A | Composition B |
|---|---|---|
| fine copper powder | 6.3 | 6.0 |
| fine lead powder | 6.3 | 6.0 |
| oil (ISO UG 680) | 64.7 | 43.0 |
| ultrahigh molecular wt. polyethylene | 14.6 | 20.0 |
| ethylene vinyl acetate copolymer | 3.2 | 5.0 |
| surface active agent[1] | 4.9 | 5.0 |
| tackifier (bitumen)[2] | — | 15.0 |

[1]Comprising the same ingredients used in the surface active agent of Example III.
[2]Available from Texaco Oil Company as CRATER ® Compound, in either viscosity grades "A" or "O".

Figure 4:
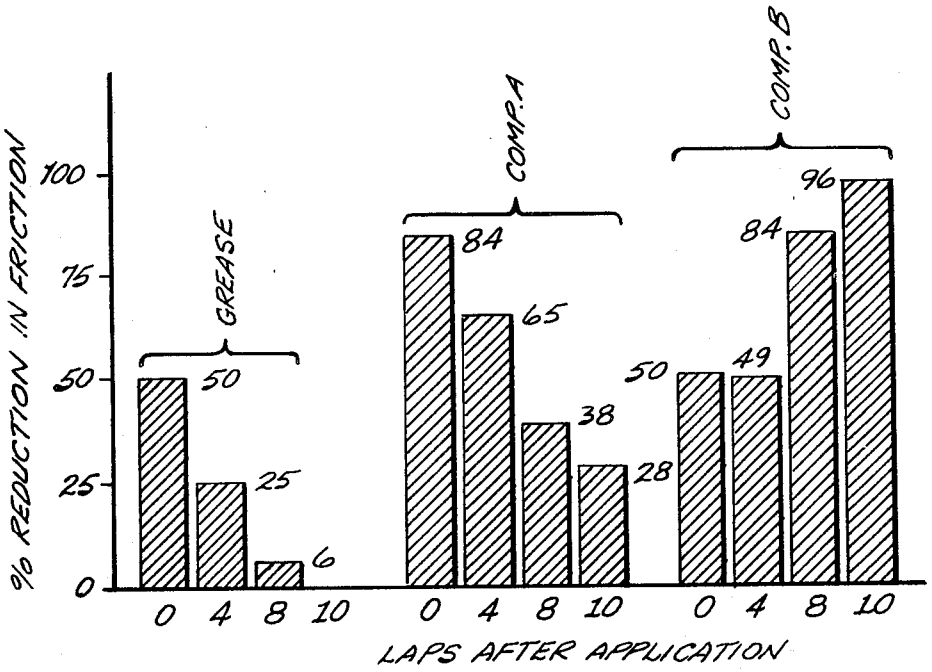
FIG. 4 is a graph showing the percent reduction in friction between rail and wheel flanges as a function of laps around a test track, for three different railcar wheel flange lubricants.

FIG. 4 illustrates the results of a test made to compare the reduction in friction between wheel flanges and rail, using: grease; composition A (solid lubricant composition without tackifier); and composition B (solid lubricant composition with tackifier). The tests were conducted on the 2.8-mile-long experimental test track loop referenced under Example IX, using a train comprising three diesel locomotives, a special lubricator car, and 85 additional cars, each loaded with approximately 100 tons of ballast.

Initially, the longitudinal friction (relative to the axle) between the wheels of the special lubricator car and the rail was determined with respect to the "dry" state (no lubrication) for successive laps of the train around the test rail loop. Grease was then applied to a test section rail of the loop, along the sides of the rail that are in contact with the wheel flanges. Following an initial 50% reduction in friction after application of the grease, the lubricating benefits of the grease rapidly diminished, until at ten laps, the friction between rail and wheels was almost the same as it was for the rail in the dry state (without lubrication).

Rods of composition A were then loaded into a special lubricant applicator mounted on the lubricator car, positioned so as to rub the solid lubricant composition against the wheel flanges on both sides of the car. After ten laps, the rods of composition A were removed, and the reduction in longitudinal friction between the wheel flanges and the rail was monitored for ten more laps. An initial reduction in friction of about 84% was measured during the first lap following removal of the solid lubricant composition rods. Even after ten laps, a significant lubricating benefit was noted.

Similarly, rods of composition B were loaded into the lubricant applicators, and the train run around the loop for ten laps to apply composition B to the wheel flanges and rails. After the rods of composition B were removed, an initial reduction in friction of about 50% was observed; however, unlike the previous tests with grease and with composition A, the friction between the wheel flanges and rails continued to decrease with each successive lap. Apparently, the tackifier in the solid lubricant composition increased the residence time of the lubricating powder on the flange/rail surfaces so that successive rail and wheel contacts forced more of the lubricating powder into the interstices of the metal surfaces. As additional lubricating powder attached and embedded into these surfaces, the friction between the surfaces continued to decrease. Although not measured in this test, it is likely that the reduced frictional force was accompanied by a concomitant reduction in wear of the metal surfaces. Without the tackifier, the solid lubricant composition is scrubbed off the metal surfaces before the benefit of the surface active agent in enhancing the attachment and embedment of the lubricating powder into the metallic surfaces is fully realized.

Substitution of tackifier for about 5% by weight of lubricating oil (keeping the proportion of the other materials listed under composition A in Example XVII otherwise the same) was found to soften the solid lubricant composition to an extent that it could not be used with a friction drive lubricant applicator being developed for use with the solid lubricant composition. In addition, tackifier and oil were found to bleed from the exposed surfaces of the solid lubricant composition to an extent likely to cause problems with contamination of shipping and storage areas and difficulty in handling. Aside from representing a potential fire hazard, the bleedthrough of oil and tackifier would likely impair proper application of the material to surfaces being lubricated due to collection of dirt and debris on its outer surface. Substitution of higher percentages of tackifier for oil in the solid lubricant composition exacerbates the softening and the oil bleeding problem. It is contemplated that tackifier may comprise from about 5% to about 65% by weight of the solid lubricant composition, and thus the problems associated with oil and tackifier bleed and softening of the composition cannot be ignored, particularly in compositions having a relatively higher content of tackifier.

Oil bleed from the exterior surface of composition A of Example XVII was found to be minimal. In addition, a strand of solid lubricant composition not including tackifier, such as composition A, is sufficiently hard to be driven by the friction drive applicator being developed for use with this product. In consideration thereof, a strand of solid lubricant composition was produced by coextruding a core including the components of composition B, covered by a concentric outer layer of the relatively harder composition A of Example XVII. The harder outer layer provides a seal that prevents oil and tackifier from bleeding out of the core, and enables the dual composition strand to be advanced by a friction drive. The extended-duration friction-reducing advantage of core composition B containing the tackifier is thus obtained without concern for the material's inherent softness and oil bleeding problems.

Figure 5:
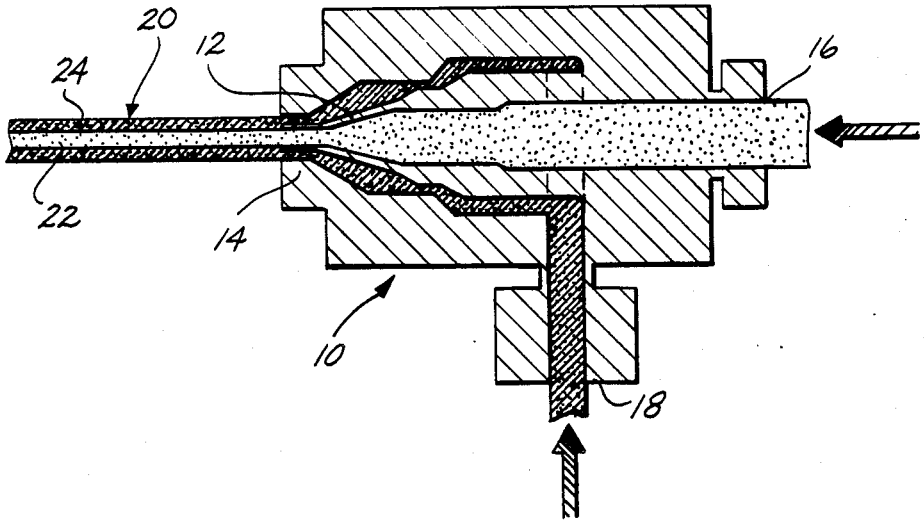
FIG. 5 is a schematic diagram of a coextrusion die.

FIG. 5 schematically illustrates a coextrusion die, generally denoted at reference numeral 10, having an inner nozzle 12 and a concentric outer nozzle 14. Inner nozzle 12 is fed through an axial port 16 with a mixture comprising the core composition from a first screwtype extruder (not shown). Outer nozzle 14 is fed through a side port 18 from a separate, second screw-type extruder (also not shown), using the composition comprising the outer layer. Both of the screw-type exturders operate otherwise substantially as described with respect to preparation of the solid lubricant composition strand in Example I. As a coextruded strand 20 emerges from coextrusion die 10, it is cooled by immersion in a water bath (not shown) and spooled on a take-up reel.

Figure 6:
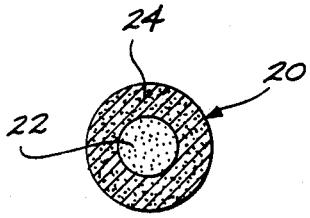
FIG. 6 is a cross-sectional view of a coextruded strand of solid lubricant composition.

A cross section of an exemplary coextruded strand 20 is shown in FIG. 6. The soft core composition including the tackifier is represented by a dotted area 22, while the outer harder layer concentrically surrounding the core is represented by a cross-hatched dotted area 24.

Alternatively, the soft core represented by dotted area 22 of coextruded strand 20 can be extruded through a single extrusion die, and then covered with the outer layer by passing it thorugh a cross-head extrusion die (not shown). Regardless of whether a coextrusion or crosshead die is used, the feed rate of the core composition and of the outer layer composition and the configuration and diameter of the die nozzles are used to control the relative diameter of the core and the outer layer. It is contemplated that a core comprising the solid lubricant composition containing a tackifier, e.g., composition B, may range from about 30% to about 90% by weight of the strand, the outer layer comprising solid lubricant composition that does not include tackifier, ranging from about 10% to about 70% by weight.

The outer layer represented by cross-hatched dotted area 24 of coextruded strand 20 may comprise simply an extrudable polymer, such as polyvinyl chloride, polyethylene, polypropylene, or polyurethane, which would serve to both strengthen the strand and provide a harder exterior coating acting as a barrier or seal against oil and tackifier bleed from the softer core composition. Coextruded strand 20 may comprise from about 80% to about 95% by weight of the solid lubricant composition containing tackifier, the remainder comprising the extrudable polymer outer layer. Desired physical properties for the outer layer may be realized, for example, by including a mineral filler, glass or organic fiber strands, or glass beads with the polymer.

A further embodiment of coextruded strand 20 is contemplated wherein, for example, the soft core comprises from about 16% to about 70% by weight of a polymeric carrier, from about 5% to about 65% by weight of a lubricating oil, from about 5% to about 65% by weight of a tackifier, and from about 0.25% to about 18% by weight of a surface active agent, the outer layer comprising from about 30% to about 60% by weight of a polymeric carrier and from about 40% to about 70% by weight of a solid lubricating powder. Rubbing a strand of these two compositions across a surface should deposit a thin film in which the components of the soft core are mixed with those of the outer concentric layer. In essence, components of the solid lubricant composition are divided between the two compositions comprising the core and outer layer of the strand and are mixed during deposition of the two compositions onto a surface. The components of the solid lubricant composition may be divided between the core and the outer layer in other combinations, as will be apparent to those of ordinary skill in the art.

While coextruded strand 20 includes two distinct compositions, it is contemplated that a strand of solid lubricant composition could be extruded that comprises a mixture of the same components of composition B but varying in concentration radially from the center of the strand to its outer surface. Such a strand could thus be made having a relatively high concentration of tackifier (e.g., from 30–65% by weight) at the center, the concentration of tackifier decreasing to virtually zero % by weight near the outer surface of the strand. The benefits of the tackifier described above would be provided by this strand, yet the outer surface should be relatively hard and free of excessive bleeding oil and tackifier.

Recent advances in extrusion technology have made it possible to produce a strand of solid lubricant composition having a radially varying concentration of components. To produce such a strand, for example, a mixture of from about 16% to about 100% by weight of a polymeric carrier, from about zero % to about 30% by weight of a lubricating oil and from about zero % to about 70% by weight of a solid lubricating powder could be mixed in a screw type extruder and injected into a longitudinal passage of an extrusion die. The extrusion die would include an injection nozzle, extending into the center of the central longitudinal passage, and oriented to inject a stream of liquid or slurry longitudinally into the extrudate as it is forced through the central longitudinal passage of the die. The pressure of the liquid or slurry injected must exceed that of the extrudate material and may lie in the range from 200 to 3000 psi. Material injected into the die could comprise, for example, from about 10% to about 95% by weight of a lubricating oil, from about 10% to about 95% by weight of a tackifier, from about 2% to about 25% by weight of a surface active agent, and from about zero % to about 70% by weight of solid lubricating powders suspended in the liquids. Downstream of the liquid injection nozzle and centered within the central passage would be disposed a static mixer vane that extends radially from the center of the passage, but only across one-half the passage diameter. The static mixer vane may be supported by the injection nozzle or by longitudinally aligned radial supports. Liquid comprising the lubricating oil, tackifier and surface active agent that is injected into the extrudate should mix with the polymeric carrier, solid lubricating powder and lubricating oil primarily within the center of the strand due to the central disposition of the liquid injection nozzle and static mixing vane, creating a mixture that varies in composition from the center of the extruded strand, radially outward. Various other combinations of the materials used in the compositions of the injected liquid and extrudate may also be employed, as should be apparent. In addition, the solid lubricant composition as just described above, may be extruded in other forms besides a circular strand.

Figure 7:
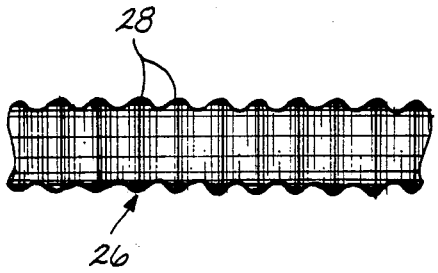
FIG. 7 is a side view of a section of solid lubricant composition strand having a circular convolution profile.
Figure 8:
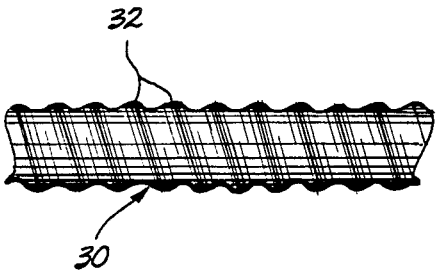
FIG. 8 is a side view of a section of solid lubricant composition strand having a helical convolution profile.

In the applicator system being developed to apply the solid lubricant composition to a moving surface, a strand of the material is advanced through a conduit. The smooth, slightly oily outer surface of the strand has been found to develop a significant frictional drag force with respect to the inner surface of the conduit. A formimg tool may be used to emboss either circular or helical convolutions on the outer surface of the solid lubricant composition strand as it exits the extruder die, while still hot and soft. Circular convolutions 28, shown on solid lubricant composition strand 26 in FIG. 7, or helical convolutions 32, shown on solid lubricant composition strand 30 in FIG. 8, reduce the surface area of the material that is in contact with the inner surface of the conduit and thereby decrease the frictional drag. A rotating captive nut having threads sized to match helical convolutions 32 could be used to drive solid lubricant composition strand 30 toward a metallic surface, as an alternative to using a frictional drive applicator.

While the present invention has been disclosed with respect to several preferred embodiments, modifications thereto will be apparent to those of ordinary skill in the art. Accordingly, the scope of the invention is not intended to be limited by the disclosure of the preferred embodiments, but instead should be construed only with respect to the claims that follow.

The embodiments of the invention in which an exclusive property or privilege is claimed are defined as follows:

1. A solid lubricant composition comprising:

(a) from about 16% to about 70% by weight of a polymeric carrier;

(b) from about 20% to about 70% by weight of a lubricating oil, said lubricating oil being soluble in said polymeric carrier;

(c) from about 10% to about 65% by weight of a solid lubricating powder selected from one or more of the group consisting of copper, lead, antimony, zinc, bismuth, tin, aluminum, magnesium, selenium, arsenic, cadmium, tellurium, graphite, and alloys thereof, in powered form; and (d) from about 0.25% to about 18% by weight of a surface acitve agent comprising a metallic dithiophosphate and an organic molybdenum compound.

2. The solid lubricant composition of claim 1, wherein the polymeric carrier is selected from one or more of the group consisting of polyethylene, polypropylene, ethylene copolymer, a metallic ionomer and polyurethane.

3. The solid lubricant composition of claim 1, wherein the surface active agent further includes one or more selected from the group consisting of synthetic sperm oil, mineral oil, inactive sulfurized fat, and a metallic naphthenate.

4. The solid lubricant composition of claim 3, wherein the metallic naphthenate comprises lead naphthenate.

5. The solid lubricant composition of claim 1, wherein the solid lubricating powder is metallic and ranges in size from about −325 mesh to about −200 mesh.

6. The solid lubricant composition of claim 1, consisting of:

(a) about 18% by weight of the polymeric carrier;

(b) about 50% by weight of the lubricating oil;

(c) about 27% by weight of the solid lubricating powder; and (d) about 5% by weight of the surface active agent.

7. The solid lubricant composition of claim 2, wherein the polyethylene comprises a mixture of an ultrahigh molecular weight polyethylene and a low molecular weight polyethylene.

8. The solid lubricant composition of claim 1, wherein the graphite has a particulate size ranging from 200 nm to 0.5 mm.

9. The solid lubricant composition of claim 3, wherein the surface active agent comprises about 8 parts by weight of synethic sperm oil, about 3 parts by weight of zinc dithiophosphate, about 2.4 parts by weight of organic molybdenum compound, about 4 parts by weight lead naphthenate and 82.6 parts by weight mineral oil.

10. The solid lubricant composition of claim 3, wherein the surface active agent comprises about equal parts by weight of inactive sulfurized fat, zinc dithiophosphate, an organic molybdenum compound, and about two parts by weight of lead napthenate.

11. The solid lubricant composition of claim 3, wherein the surface active agent comprises about 3 parts by weight inactive sulfurized fat, about 1 part by weight zinc dithiophosphate and about 2 parts by weight organic molybdenum compound.

12. The solid lubricant composition of claim 1, wherein the ratio of the solid lubricating powder to the surface active agent by weight is in the range of 5/1 to 20/1.

13. The solid lubricant composition of claim 1, wherein the lubricating oil is selected from the group consisting of vegetable oil, mineral oil, and synthetic oil.

14. The solid lubricant compcsition of claim 1, wherein the composition is mixed and extruded in a flexible strand which may be freely coiled.

15. The solid lubricant composition of claim 14, wherein the strand includes convolutions extending along its outer surface.

16. The solid lubricant composition of claim 15, wherein the convolutions comprise a helix.

17. The solid lubricant composition of claim 1, wherein the composition is mixed and molded into one of a brick and a rod.

18. The solid lubricant composition of claim 1, wherein the composition is cured by heating to a temperature in excess of 300° F.

19. The solid lubricant composition of claim 1, wherein the polymeric carrier comprises from about 16% to about 25% by weight of polyethylene, the lubricating oil comprises from about 49% to about 63% of mineral oil, the solid lubricating powder comprises from about 10% to about 16% by weight, and the surface active agent comprises from about 6% to about 16% by weight.

20. A method for preparing a solid lubricant composition suitable for reducing friction and wear of a metallic surface when rubbed onto the surface in a thin film, comprising the steps of:

(a) mixing a polymeric carrier, a lubricating oil, a solid lubricating powder selected from one or more of the group consisting of copper, lead, antimony, zinc, bismuth, tin, aluminum, magnesium, selenium, arsenic, cadmium, tellurium, graphite, and alloys thereof, in powdered form and a surface active agent;

(b) extruding the mixture under pressure while heating it, thereby subjecting the mixture to a shearing force and a compaction that prevents the solid lubricant composition from being brittle;

(c) forming the mixture into a desired shape; and (d) curing the mixture.

21. The method of claim 20, wherein the step of forming the mixture comprises the step of forming the mixture into a flexible strand.

22. The method of claim 21, further comprising the step of embossing the strand to produce convolutions along its longitudinal axis.

23. The method of claim 22, wherein the convolutions form a helix.

24. The method of claim 18, wherein the step of forming the mixture comprises the step of molding the mixture into one of a brick and a rod.

25. The method of claim 18, wherein the step of curing the mixture comprises the step of heating the mixture to a temperature in excess of 300° F. for a sufficiently long time to achieve homogeneous melting of the polymeric carrier.

26. The method of claim 18, wherein the polymeric carrier is selected from one or more of the group consisting of polyethylene, polypropylene, ethylene copolymer, a metallic ionomer, and polyurethane.

27. The method of claim 18, wherein the lubricating oil is soluble in the polymeric carrier and is selected from one or more of the group consisting of mineral oil, vegetable oil, and synthetic oil.

28. The method of claim 27, wherein the solid lubricating powders are metallic and are sized in the range −325 to −200 mesh.

29. The method of claim 20, wherein the solid lubricating powders comprise a mixture of substantially equal parts by weight of copper and lead.

30. The method of claim 18, wherein the surface active agent comprises a metallic dithiophosphate, an organic molybdenum compound, and one or more selected from the group consisting of synthetic sperm oil, mineral oil, inactive sulfurized fat, and a metallic naphthenate.

31. The method of claim 26, wherein the metallic naphthenate comprises lead naphthenate.

32. A method for lubricating a moving metallic surface to reduce friction and wear, using a solid lubricant composition comprising a polymeric carrier, a lubricating oil, a solid lubricating powder selected from one or more of the group consisting of copper, lead, antimony, zinc, bismuth, tin, aluminum, magnesium, selenium, arsenic, cadmium, tellurium, graphite, and alloys thereof, in powdered form, and a surface active agent, comprising the steps of:

(a) forming the solid lubricant composition into a desired shape;

(b) biasing the formed solid lubricant composition against the moving metallic surface;

(c) depositing a thin film of the solid lubricant composition on the moving metallic surface; and (d) applying pressure to attach and embed the solid lubricant powder into the metallic surface.

33. The method of claim 28, wherein the step of forming the solid lubricant composition comprises the step of forming it into one of a flexible strand, a brick, and a rod.

34. The method of claim 28, further comprising the step of enhancing the attachment and embedment of the solid lubricating powder on the metallic surface using the surface active agent.

35. The method of claim 32, wherein the size of the solid lubricant powder is in the range −325 to −200 mesh.

36. The method of claim 28, wherein the polymeric carrier is selected from one or more of the group consisting of polyethylene, polypropylene, ethylene copolymer, a metallic ionomer, and polyurethane.

37. The method of claim 28, wherein the surface active agent comprises a metallic dithiophosphate and an organic molybdenum compound.

38. The method of claim 28, wherein the moving metallic surface comprises a wheel of a railcar, further comprising the step of transferring the solid lubricant composition from the wheel to a rail on which the wheel runs and, thence, to a plurality of other railcar wheels.

39. The method of claim 34, wherein the step of applying pressure comprises the step of rolling the railcar wheels along the rail.

40. A solid lubricant composition comprising:

(a) from about 16% to about 70% by weight of a polymeric carrier;

(b) from about 5% to about 65% by weight of a lubricating oil, said oil being soluble in said polymeric carrier;

(c) from about 5% to about 65% by weight of a tackifier;

(d) from about 10% to about 65% by weight of a solid lubricating powder selected from one or more of the group consisting of copper, lead, antimony, zinc, bismuth, tin, aluminum, magnesium, selenium, arsenic, cadmium, tellurium, graphite, and alloys thereof in powdered form; and (e) from about 0.25% to about 18% by weight of a surface active agent comprising a metallic dithiophosphate and an organic molybdenum compound.

41. The solid lubricant composition of claim 40, wherein the polymeric carrier is selected from one or more of the group consisting of polyethylene, polypropylene, ethylene copolymer, a metallic ionomer and polyurethane.

42. The solid lubricant composition of claim 40, wherein the surface active agent further includes one or more selected from the group consisting of synthetic sperm oil, mineral oil, inactive sulfurized fat, and a metallic naphthenate.

43. The solid lubricant composition of claim 42, wherein the metallic naphthenate comprises lead naphthenate.

44. The solid lubricant composition of claim 40, wherein the tackifier comprises bitumen.

45. The solid lubricant composition of claim 40, consisting of:

(a) about 25% by weight of the polymeric carrier;

(b) about 43% by weight of the lubricating oil;

(c) about 15% by weight of the tackifier;

(d) about 12% by weight of the solid lubricating powder; and (e) about 5% by weight of the surface active agent.

46. The solid lubricant composition of claim 41, wherein the polyethylene comprises a mixture of an ultrahigh molecular weight polyethylene and a low molecular weight polyethylene.

47. The solid lubricant composition of claim 40, wherein the composition is mixed and extruded in a flexible strand, which may be freely coiled.

48. The solid lubricant composition of claim 40, wherein the composition is mixed and molded into one of a brick and a rod.

49. The solid lubricant composition of claim 40, wherein the composition is cured by heating to a temperature in excess of 300° F.

50. The method of claim 20, wherein the step of mixing includes the step of mixing a tackifier with the polymeric carrier, the lubricating oil, the solid lubricating powder and the surface active agent.

51. The method of claim 50, wherein the tackifier comprises bitumen.

52. The method of claim 32, wherein the solid lubricant composition further comprises a tackifier.

53. The method of claim 52, wherein the tackifier comprises bitumen.

54. The method of claim 52, further comprising the step of increasing the adherence of the solid lubricant composition to the metallic surface using the tackifier.

55. The method of claim 54, further comprising the step of enhancing the attachment and embedment of the solid lubricating powder on the metallic surface using the surface active agent, the tackifier serving to increase the residence time of the solid lubricating powder on the metallic surface and thereby increasing the amount of solid lubricating powder attached and embedded into the metallic surface.

56. An article of solid lubricant composition, comprising: first and second distinct compositions, the first composition comprising a core covered by a layer of the second composition, said solid lubricant composition including a polymeric carrier, a lubricating oil, a solid lubricating powder and a surface active agent, the first composition being substantially softer than the second composition, wherein the first composition comprises:

(a) from about 16% to about 70% weight of the polymeric carrier;

(b) from about 5% to about 65% by weight of the lubricating oil;

(c) from about 5% to about 65% by weight of a tackifier;

(d) from about 10% to about 65% by weight of the solid lubricating powder; and (e) from about 0.25% to about 18% by weight of the surface active agent; and wherein the second composition comprises a polymer material.

57. The article of solid lubricant composition of claim 56, wherein the article is coextruded as a flexible strand.

58. The article of claim 57, wherein the strand includes convolutions extending along its outer surface.

59. The article of claim 58, wherein the convolutions comprise a helix.

60. The article of solid lubricant composition of claim 56, wherein the first composition includes a tackifier.

61. The article of solid lubricant composition of claim 60, wherein the tackifier is bitumen.

62. The article of solid lubricant composition of claim 56, wherein the second composition comprises a polymer.

63. The article of solid lubricant composition of claim 56, wherein components of the solid lubricant composition are divided between the first composition and the second composition, said components of the solid lubricant composition being deposited and mixed as the article is rubbed across a surface.

64. The article of solid lubricant composition of claim 56, wherein the article comprises a strand.

65. A method for making an article of solid lubricant composition comprising a polymeric carrier, a lubricating oil that is soluble in the polymeric carrier, a solid lubricating powder and a surface active agent, said method comprising the steps of: extruding a first composition as a core of the article, and extruding a second composition as a composition as a substantially concentric layer around said core, the second composition sealingly enclosing the first composition along a longitudinal axis of the core and being substantially harder than the first composition wherein the first composition comprises:

(a) from about 16% to about 70% by weight of the polymeric carrier;

(b) from about 5% to about 65% by weight of the lubricating oil;

(c) from about 5% to about 65% by weight of a tackifier;
(d) from about 10% to about 65% by weight of the solid lubricating powder; and
(e) from about 0.25% to about 18% by weight of the surface active agent, and wherein the second composition comprises:
(a) from about 16% to about 70% by weight of the polymeric carrier;
(b) from about 5% to about 65% by weight of the lubricating oil;
(c) from about 10% to about 65% by weight of the solid lubricating powder;
(d) from about 0.25% to about 18% by weight of the surface active agent.

66. The method of claim 65, wherein the first and second compositions are coextruded through concentric dies.

67. The method of claim 65, wherein an extrudate core of the first composition is coated with the second composition by passing the core through a second extrusion die.

68. The method of claim 65, wherein the second composition comprises an extrudable polymer.

69. The method of claim 65, wherein the tackifier comprises bitumen.

70. The method of claim 65, wherein the article comprises a flexible strand, including from about 80% to about 95% by weight of the first composition and from about 5% to about 20% by weight of the second composition, said second composition comprising an extrudable flexible polymer that acts as a barrier to prevent lubricating oil and tackifier bleeding from the core.

71. The method of claim 65, wherein the solid lubricating powder is selected from one or more of the group consisting of copper, antimony, zinc, bismuth, tin, aluminum, magnesium, selenium, arsenic, cadmium, tellurium, graphite, and alloys thereof, and molybdenum disulfide, all in powder form.

72. The method of claim 65, wherein the polymeric carrier is selected from one or more of the group consisting of polyethylene, polypropylene, ethylene copolymer, a metallic ionomer and polyurethane.

73. The method of claim 65, wherein components of the solid lubricant composition are divided between the first and second composition.

74. The method of claim 65, wherein the article comprises a flexible strand, including from about 30% to about 90% by weight of the first composition, and from about 10% to about 70% by weight of the second composition.

75. A method for producing a strand of solid lubricant composition having a relatively soft inner core and a relatively harder outer layer concentric to the core, comprising the steps of:
(a) mixing from about 16% to about 70% by weight of a polymeric carrier, from about 5% to about 65% by weight of a lubricating oil, from about 5% to about 65% by weight of a tackifier and from about 0.25% to about 18% by weight of a surface active agent;
(b) extruding the mixture of step (a) to form the core;
(c) mixing from about 30% to about 60% by weight of a polymeric carrier and from about 40% to about 70% by weight of a solid lubricating powder; and
(d) extruding the mixture of step (c) about the core as the outer layer of the strand, said outer layer acting as a barrier to prevent oil and tackifier bleeding from the core.

76. An article of solid lubricant composition comprising first and second compositions, wherein the first composition comprises:
(a) from about 16% to about 70% by weight of the polymeric carrier;
(b) from about 5% to about 65% by weight of the lubricating oil;
(c) from about 5% to about 65% by weight of a tackifier;
(d) from about 10% to about 65% by weight of the solid lubricating powder; and
(e) from about 0.25% to about 18% by weight of the surface active agent, and wherein the second composition comprises:
(a) from about 16% to about 70% by weight of the polymeric carrier;
(b) from about 5% to about 65% by weight of the lubricating oil;
(c) from about 10% to about 65% by weight of the solid lubricating powder;
(d) from about 0.25% to about 18% by weight of the surface active agent;

said first and second compositions being combined to form said article so that the center of said article is substantially softer than the outer surface of said article.

77. The article of solid lubricant composition of claim 76, wherein the concentration of tackifier is greatest proximate the center of the article.

78. The article of solid lubricant composition of claim 76, wherein the concentration of tackifier is lowest at the outer surface of the article.

* * * * *

UNITED STATES PATENT AND TRADEMARK OFFICE

CERTIFICATE OF CORRECTION

PATENT NO. : 4,915,856

DATED : April 10, 1990

INVENTOR(S) : Warren E. Jamison

It is certified that error appears in the above-identified patent and that said Letters Patent is hereby corrected as shown below:

| Column | Line | |
|---|---|---|
| 5 | 5 | "lubricanting" should be --lubricating-- |
| 6 | 37 | "compostion" should be --composition-- |
| 7 | 43 & 44 | "EXAMPLE II" should be --EXAMPLE III-- |
| 10 | 32 | after "grade" insert --powder-- |
| 10 | 33 | "Heaveatex" should be --Heveatex-- |
| 10 | 39 | "lubricant" should be --lubricating-- |
| 10 | 39 | "matallic" should be --metallic-- |
| 10 | 68 | "15.1≠%" should be --15.1%-- |
| 11 | 2 | "material" should be --materials-- |
| 11 | 36 | "liqiud" should be --liquid-- |
| 14 | 9 | "Howvever," should be --However,-- |
| 14 | 39 | "without" should be --without-- |
| 14 | 40 | "with" should be --with-- |
| 16 | 5 | "exturders" should be --extruders-- |
| 16 | 21 | "crosshead" should be --cross-head-- |
| 17 | 60 & 61 | "formimg" should be --forming-- |
| 18 | 27 | "powered" should be --powdered-- |
| 18 | 29 | "acitve" should be --active-- |
| 18 | 64 | "synethic" should be --synthetic-- |
| 19 | 5 | "napthenate" should be --naphthenate-- |
| 19 | 66 | "18" should be --20-- |
| 20 | 1 | "18" should be --20-- |

UNITED STATES PATENT AND TRADEMARK OFFICE

CERTIFICATE OF CORRECTION

PATENT NO. : 4,915,856

DATED : April 10, 1990

INVENTOR(S) : Warren E. Jamison

It is certified that error appears in the above-identified patent and that said Letters Patent is hereby corrected as shown below:

| Column | Line | |
|---|---|---|
| 20 | 6 | "18" should be --20-- |
| 20 | 10 | "18" should be --20-- |
| 20 | 20 | "18" should be --20-- |
| 20 | 26 | "26" should be --30-- |
| 20 | 45 | "28" should be --32-- |
| 20 | 49 | "28" should be --32-- |
| 20 | 56 | "28" should be --32-- |
| 20 | 60 | "28" should be --32-- |
| 20 | 63 | "28" should be --32-- |
| 21 | 1 | "34" should be --38-- |
| 22 | 59 | Delete "as a composition" |
| 23 | 13 | After ";" insert --and-- |
| 23 | 36 | After "copper," insert --lead,-- |
| 24 | 39 | After ";" insert --and-- |

Signed and Sealed this

Fourteenth Day of January, 1992

*Attest:*

HARRY F. MANBECK, JR.

*Attesting Officer*

*Commissioner of Patents and Trademarks*